US005438925A

United States Patent [19]

Ohmi et al.

[11] Patent Number: 5,438,925

[45] Date of Patent: Aug. 8, 1995

[54] LADDER FOR CLIMBING UP TO AND DOWN FROM WORKING FLOOR OF PRINTING PRESS

[75] Inventors: Takashi Ohmi, Yokohama, Japan; Takayuki Baba, Kawasaki, both of Japan

[73] Assignee: Tokyo Kikai Seisakusho, Ltd., Tokyo, Japan

[21] Appl. No.: 253,919

[22] Filed: Jun. 3, 1994

[30] Foreign Application Priority Data

Sep. 20, 1993 [JP] Japan ..... 5-255261

[51] Int. Cl.[6] ..... B41F 5/00

[52] U.S. Cl. ..... 101/212; 101/216; 182/93; 182/95; 182/97

[58] Field of Search ..... 101/212, 216, 221, 219, 101/112, 151, 228, 156, 181, 183, 222, 232; 182/95, 97, 93

[56] References Cited

U.S. PATENT DOCUMENTS

| | | | |
|---|---|---|---|
| 906,954 | 12/1908 | Sponholz | 182/95 |
| 2,819,005 | 1/1958 | Roberts | 182/97 |
| 2,840,290 | 6/1958 | Roberts | 182/97 |
| 4,370,927 | 2/1983 | Fischer | 101/228 |
| 5,022,491 | 6/1991 | Gill | 182/95 |

FOREIGN PATENT DOCUMENTS

| | | | |
|---|---|---|---|
| 2435972 | 7/1974 | Germany | 101/181 |

OTHER PUBLICATIONS

"Cline System Controls the Press" Cline Electrical Mfg. Co. Mar. 1929.

*Primary Examiner*—Edgar S. Burr
*Assistant Examiner*—Anthony H. Nguyen
*Attorney, Agent, or Firm*—Armstrong, Westerman, Hattori, McLeland & Naughton

[57] ABSTRACT

A ladder for contraction and storage on an upper working floor of a printing press having a plurality of vertically arranged working floors for access to said printing press at said working floors, such ladder having a plurality of substantially equal length sections coupled to each other at overlapping ends of said sections at side rack of said ladder for expanding and contracting such ladder, the upper end of the upper-most ladder section, when such ladder is expanded, having coupling means engageable with rails on such upper working floors for guiding such ladder, when contracted, into a horizontal position at such upper working floor for storage and for guiding such contracted ladder to a position at the end of such upper working floor for movement from a horizontal storage position to a substantially vertical expanded position for extension between such upper working floor and a working floor therebelow and means for locking such plurality of coupled sections into such contracted position for storage.

4 Claims, 4 Drawing Sheets

LADDER FOR CLIMBING UP TO AND DOWN FROM WORKING FLOOR OF PRINTING PRESS

BACKGROUND OF THE INVENTION

1. Field of the Invention

The present invention relates to a ladder for climbing up to and down from an upper working floor that is set up for a printing press in which press unit is arranged in tiers.

2. Description of the Prior Art

Japanese Patent Laid-Open Nos. 180345/1991, 371835/1992 and Japanese Utility Model Laid-Open No. 56433/1993 disclose working floors for operating a press units at the second and higher floors that are provided for a printing press in which the press unit is arranged in tiers.

The working floor disclosed in Japanese Patent Laid-Open No. 180345/1991 is, as shown in FIG. 1, of a fixed type which is provided outside the press unit. The working floors disclosed in Japanese Patent Laid-Open No. 371835/1992 are of a type that are driven to be elevated or lowered and provided outside the press unit and a fixed type and a bascule type provided outside the press unit. The working floor disclosed in Japanese Utility Model Laid-Open No. 56433/1993 is of a fixed type provided outside the press unit.

There have further been known working floors of a fixed type and bascule type provided inside the press unit arranged in tiers, i.e., provided on the bottom of the lower space, the so called arch, sandwiched by two plate cylinders so as to do work in the arch.

In the above-mentioned conventional working floors, except the working floor of the elevation type disclosed in Japanese Patent Laid-Open No. 371835/1992, a stair case as disclosed in, for example, Japanese Utility Model Laid-Open No. 56433/1993, or a ladder, is provided at a suitable place so as not to hinder workings and walking. In the case of the working floor of a bascule type, a ladder is secured to the working floor of the fixed type that is coupled to the working floor of the bascule type. The workers go up and down using such stair case or ladder.

To install a staircase, as disclosed in Japanese Utility Model Laid-Open No. 56433/1993, at a suitable place that does not hinder the working and walking, generally the place is relatively remote from the press unit. In this case, however, the workers must take a detour to go to the desired working floor making it inconvenient for him to quickly take a measure in an emergency.

To go to and from the working floors of the second and fourth tiers in an arch, in particular, disclosed in Japanese Patent Laid-Open No. 371835/1992 and Japanese Utility Model Laid-Open No. 56433/1993, it is necessary to use a separate ladder or a stepladder and to move and set ladders or stepladders causing the working efficiency to be very low. Furthermore, a fixed ladder, partly closes the front cover that has a function of operating the rotary press and, thus, lacks practicability.

The working floors of the type driven to be elevated and lowered, disclosed in Japanese Patent Laid-Open No. 371835/1992, can be conveniently used. However, the floors themselves are large in scale, manufactured at an increased cost, and further requires an increased running cost for maintaining and checking operation units.

SUMMARY OF THE INVENTION

The object of the present invention is to provide a ladder for going up to and down from the working floors, which simultaneously solves the above-mentioned problems involved in the prior art.

In a printing press in which the press unit is arranged in tiers and an upper working floor is provided, a ladder for going up to and coming down from the working floor of the rotary press comprising a plurality of divided units that are connected together extendably, one end of the ladder in the extended state is engaged with a fixing portion that is provided on the upper working floor or on a tread coupled to the upper working floor in such a way as to move between a place where the contracted ladder is accommodated and a place where the extended ladder is used. The other end of the ladder can be extended toward the lower working floor. In the contracted state, the stair is accommodated on the upper working floor or on the tread coupled to the upper working floor.

The ladder for going up to and down from the working floor of the rotary press, i.e., the ladder for climbing up to and down from the upper operation floor is normally folded and accommodated on the upper working floor or on the tread coupled to the upper working floor.

To use the ladder, the ladder accommodated in the contracted state is moved by hand, the upper end of the ladder is brought to a use position at the mounting portion, and the ladder is extended to a predetermined length while pulling down the lower end portion of the divided part until it comes into contact with, or close to, the lower working floor.

In this state, the worker can climb up the ladder to the upper working floor, or to the tread coupled to the upper working floor, from the lower working floor and carry out the work on the upper working floor. Similarly, after the work is finished, the worker comes down to the lower working floor from the upper working floor.

To fold and accommodate the ladder after it is used, the divided unit of the lower side is held by hand, and the stair is contracted and is so pulled up that the divided units are superposed one upon the other. Next, the upper end of the contracted ladder is moved to the contraction and accommodation position at the mounting portion, and the ladder is placed on the upper working floor or on the tread coupled to the upper working floor.

The above and other objects, features and advantages of the present invention will become apparent from reading of the following description which has been made in connection with the accompanying drawings.

BRIEF DESCRIPTION OF THE DRAWINGS

The present invention is illustrated in the following drawings in which.

DESCRIPTION OF THE PREFERRED EMBODIMENTS

A ladder for climbing up to and down from a working floor of a printing press of an embodiment according to the present invention will now be described in conjunction with the drawings.

First, the printing press equipped with the ladder for climbing up to and down from the working floor of the embodiment of the present invention will be described in conjunction with FIG. 6.

Figure 6:
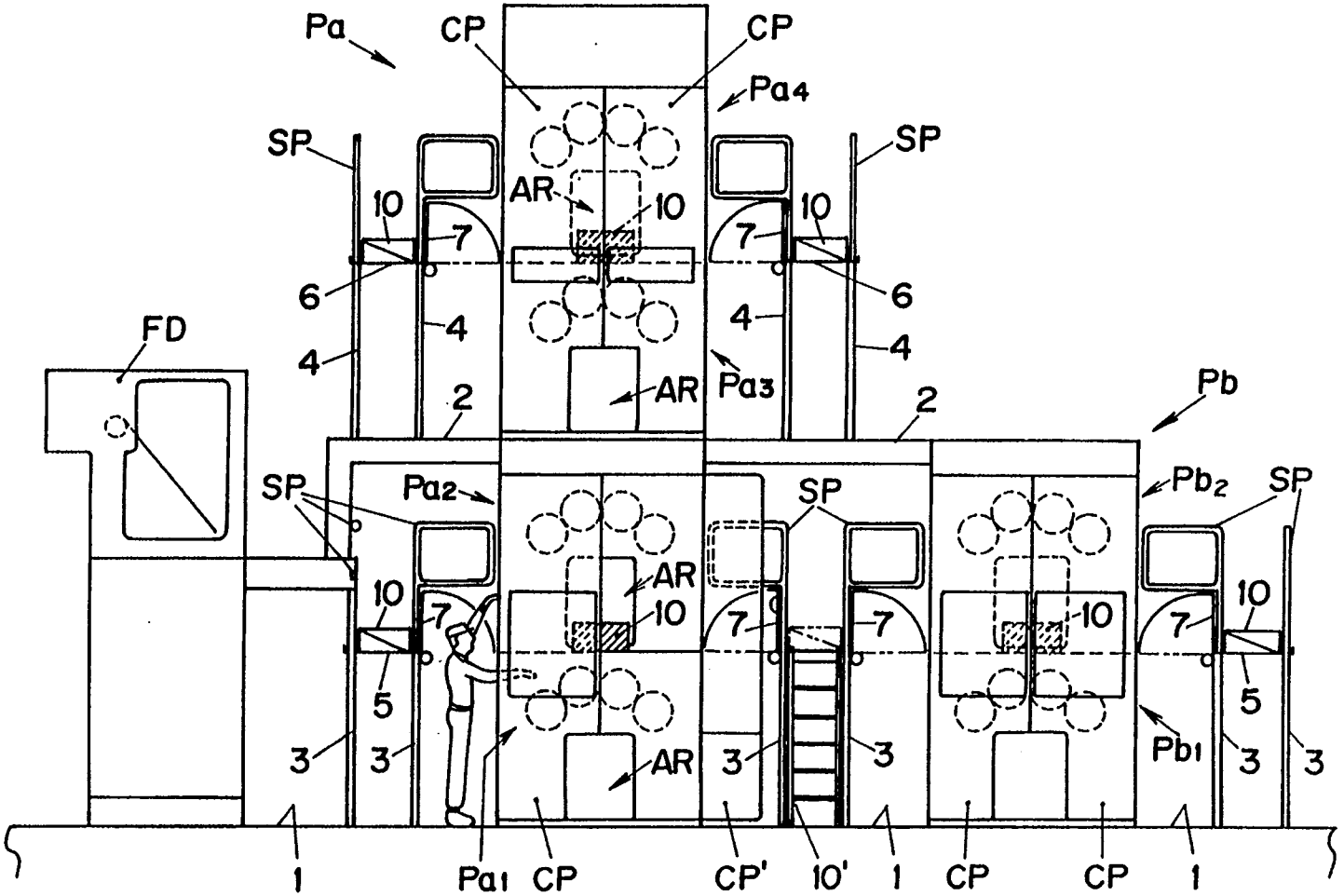
FIG. 6 is a diagram illustrating the constitution of a printing press equipped with the ladder for climbing up to and down from the working floor of the embodiment according to the present invention.

In FIG. 6, a printing press Pa is provided with four press units Pa1, Pa2, Pa3, Pa4, and a printing press Pb is provided with two press units Pb1 and Pb2, which are arranged in tiers in the direction of height. A working floor 1 chiefly for the press unit Pa1 and the press unit Pb1, and a working floor 2 chiefly for the press unit Pa3, are fixedly provided. Support poles 3 are erected on the working floor 1 and support poles 4 are erected on the working floor 2. The support poles 3 support a working floor 5 chiefly for the press units Pa2 and Pb2, and the support poles 4 support a working floor 6 chiefly for the press unit Pa4. Moreover, working floors 7 of a bascule type are provided and connected to the working floors 5 and 6.

Figure 3:
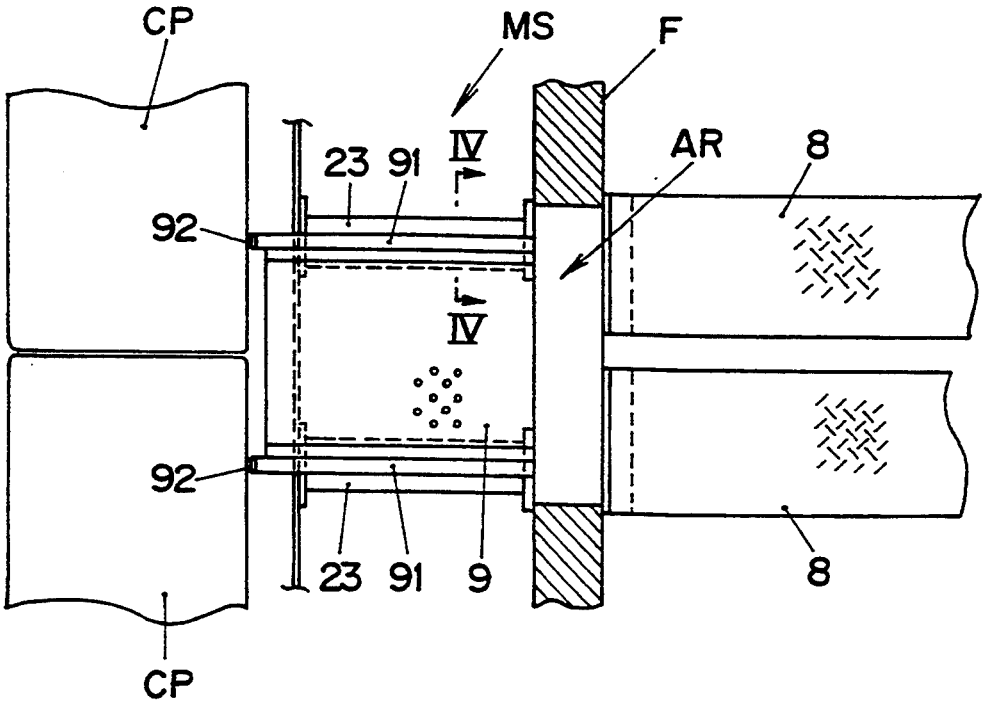
FIG. 3 is a partial sectional view taken along the line 3—3 of FIG. 1.
Figure 4:
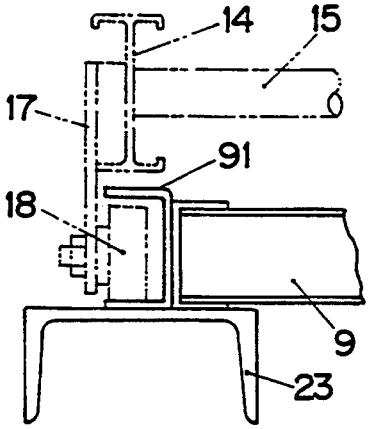
FIG. 4 is a partial sectional view taken along the line 4—4 of FIG. 3.

In the arch sections AR of the press units Pa1, Pa2, Pa3, Pa4, Pb1 and Pb2 are provided intra-arch working floors 8 of bascule type that shown in FIG. 3.

Pairs of press units Pa1 and Pa2, Pa3 and Pa4, and Pb1 and Pb2 are covered with double operation panels CP that can open, like a folding door (In FIG. 6, CP' represents operation panels in an open state). A mechanical region MS, accommodating a mechanism for operating the printing presses Pa, Pb provided between these operation panels CP and the frame F of the printing presses Pa, Pb, is covered with a special cover securing the entrances to the arch portions. Furthermore, the working floors 5 and 6 are provided with safety handrails SP. A folding machine FD is installed adjacent to the printing presses Pa and Pb.

In the printing presses Pa and Pb shown in FIG. 6, ladders 10 shown in FIGS. 1 to 4 are provided (in FIG. 6, reference numeral 10 denotes ladders in the folded state, and 10' denotes a ladder that is being used), so that the worker can go from the working floor 1 to the working floor 5 or to the intra-arch working floors 8 in the press units Pa2 and Pb2, or can go from the working floor 2 to the working floor 6 or to the intra-arch working floor 8 in the press unit Pa4.

Described below, in further detail with reference to FIGS. 1 to 4, are the ladder 10 by which the worker can go to the intra-arch working floor 8 in the press units Pa2 and Pb2 from the working floor 1 or can go to the intra-arch working floor 8 in the press unit Pa4 from the working floor 2.

The ladders 10 are of a type which is constituted by three divided units 11, 12 and 13, each divided unit having a suitable number of cross members or steps 15, 15,—of which both ends are attached to both side frames 14, 14 of steel I-beams. Both side frames 14, 14 of the divided unit 12 are provided at both ends thereof with coupling members 16 that embrace flanges of both side frames 14, 14 of the divided units 11 and 13 in the state in which the three divided units 11, 12 and 13 are overlapped, and both side frames 14, 14 of the divided units 11 and 13 are similarly provided at the ends on one side thereof with coupling members 16 that embrace flanges of both side frames 14, 14 of the divided unit 12.

The coupling members 16 slidably embrace the flanges of both side frames 14, 14 and are engageable with each other. Therefore, the three divided units 11, 12 and 13 are connected to each other to slide in the lengthwise direction; i.e., the ladder 10 extends and contracts in the longitudinal direction, and the divided units 11, 12 and 13 in the extended state are positioned relative the each other. In the contracted state, the divided units 11, 12 and 13 are positioned relative to each other since the coupling members 16 come into contact with the stopper plates (not shown) provided at short portions of both side frames 14, 14.

The structure for mounting the ladder 10 is as described below.

A roller 18 is rotatably mounted via a bracket 17 on the other end portion of both frames (end portions without coupling member 16) of both frames of the divided unit 11, and a ferrule portions 19 are provided at the other end portions of both side frames (end portions without coupling member 16) of the divided unit 13. The rollers 18 engage with guide members provided on both sides of a tread 9 (appearing later) and move along the guide members 91. Therefore, the ladders 10 that are extended and used are supported at the protruded portions 19 by the working floors 1 and 2 (shown by chain lines in FIG. 1).

When extended and used, the other end portions of both side frames (end portions without coupling member 16) of the divided unit 13 don't need to reach the working floors 1 and 2 but may be close thereto, and the divided units 11, 12 and 13 may be hanged down via the rollers 18 and the coupling members 16. In this case, the ferrule portions 19 are not necessary (see FIG. 5).

A stop pin 22, tied by a chain 21 to the side frame of the divided unit 13, is detachably inserted through holes having a common axis formed in the perforated hook-like brackets 20, 20, 20 that are mounted at common places on the side frame of the divided units 11, 12 and 13 of the ladder 10 that is in the folded state. The stop pin 22 inserted prevents the divided units 11, 12 and 13 of the ladder 10 that is folded and accommodated from sliding relative to each other.

In the mechanical region MS, behind the closed operation panels CP, is provided the tread 9 that is connected to the intra-arch working floor 8 via a frame F, the tread 9 having guide members 91, 91 of channel steels along both side edges thereof. Both sides of the tread 9 and the guide members 91, 91 are secured to brackets 23, 23 of channel steels that are mounted on the frame F and are protruding into the mechanical region MS (see FIG. 4).

At the tips of the guide members 91 provided stop members 92 at a position where it comes into contact with the rollers 18 when the ladder 10 is extended and is pulled down, and the base end of the guide member 91 is opposed to the frame F. The ladder 10 that is pulled down to a state for use is then fixed in a position by the contact of the rollers 18 with the stop members 92, and is further positioned in the folded state and accommodated as the rollers 18 come into contact with the frame F.

Figure 1:
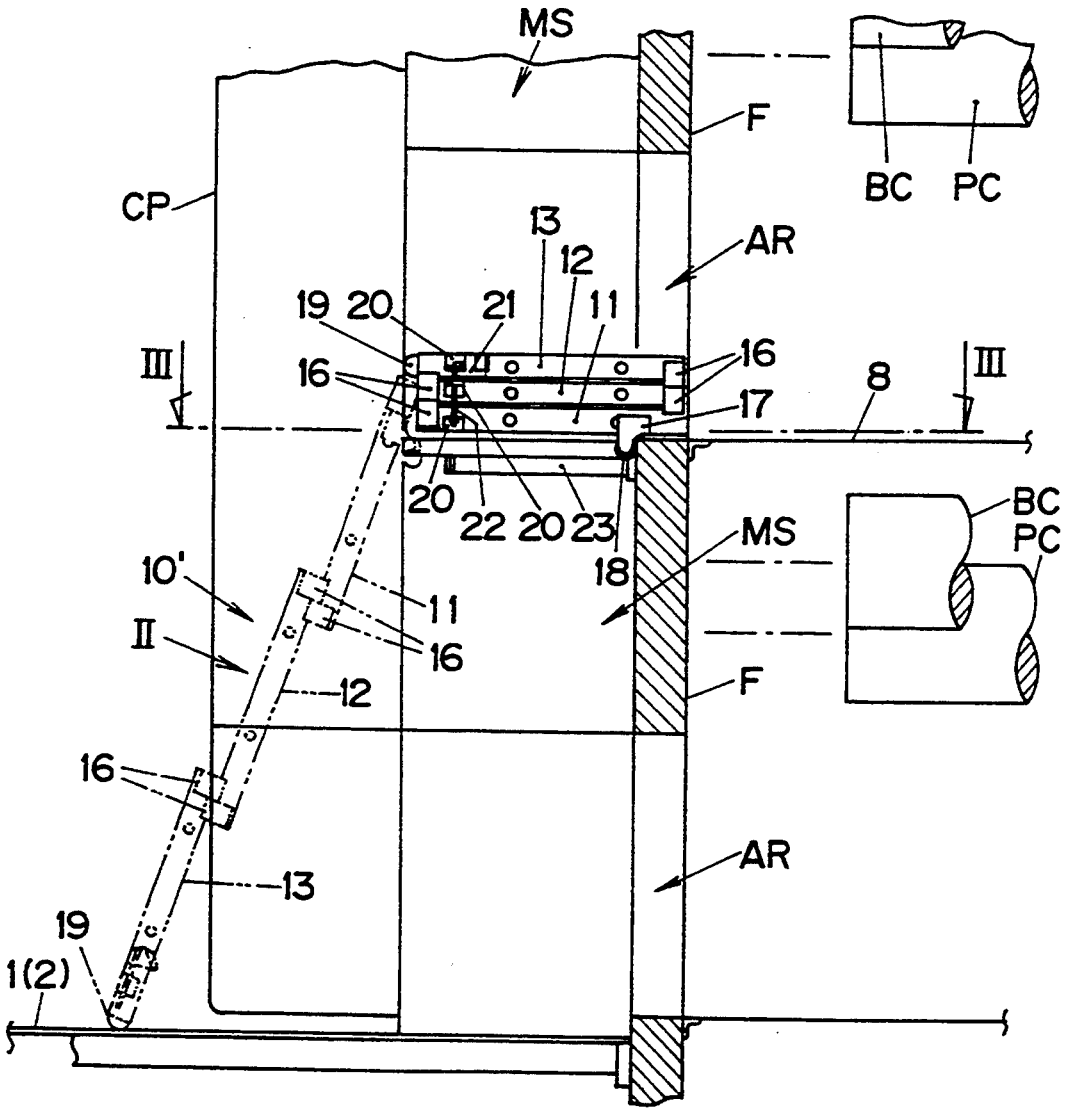
FIG. 1 is a diagram illustrating the constitution of a ladder for climbing up to and down from the working floor provided for a printing press of an embodiment of the present invention.

In FIG. 1, symbol PC denotes a plate cylinder and BC denotes a blanket cylinder.

Figure 2:
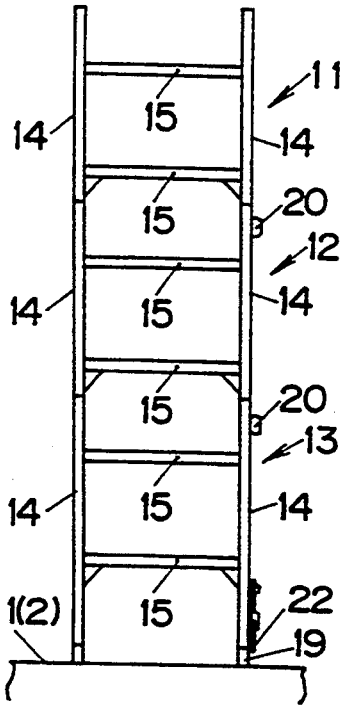
FIG. 2 is a diagram of the ladder (in a used state) for climbing up to and down from the working floor of the embodiment of the present invention of FIG. 1, when it is viewed in the direction of arrow A.

The above-mentioned ladder 10, i.e., the ladder 10 for climbing up to and down from the intra-arch working floor 8 is normally folded and is accommodated on the tread 9 behind the closed operation panels CP as indicated by solid lines in FIG. 2.

To use the ladder 10, the operation panels CP are first opened. Next, the divided units 13 of the ladder 10 are held by hand, the ladder 10 of which the divided units have been prevented by the stop pin 22 from sliding is drawn rightward in FIG. 1 along the guide members 91, 91 until the rollers 18, 18 come into contact with the stop members 92, 92, thereby to determine the position of the upper end portion of the ladder 11.

Then, the stop pin 22 is removed from the hole of the perforated hook-like bracket 20, the divided units 11, 12 and 13 of the ladder 10 are permitted to slide relative to each other, the ladder 10 is extended to a predetermined length, determined by the contact of the coupling members 16, the divided units 13 are pulled down, the ferrule portions 19, 19 are brought into contact with the lower working floor 1 (or 2), so that the ladder 10 is stably extended between the tread 9 and the working floor 1 (or 2) as indicated by dash-and-dot chain line in FIG. 1.

In this state, the worker climbs up the ladder 10 to the tread 9 from the working floor 1 (or 2) and goes to the intra-arch working floor 8 passing through the frame F to carry out the work inside the arch. After the work is finished, the worker returns to the working floor 1 (or 2) from the intra-arch working floor 8 in the same manner as above.

When the ladder 10 is folded and accommodated, after it has been used, the divided units 13 are first held by hand and the ladder 10 is pulled up and contracted until the divided units 11, 12 and 13 are superposed, one upon the other, and the coupling members 16 come into contact with each other. Next, the stop pin 22 is inserted in the holes of the perforated hook-like brackets 20 which are in alignment with each other. The divided units 11, 12 and 13 are then locked into a unitary structure and are prevented from sliding relative to each other. The ladder 10 is then pushed toward the right in FIG. 1 until the rollers 18, 18 come into contact with the frame F along the guide members 91, 91, and accommodated and placed on the tread 9. The operating panels CP are then closed.

Figure 5:
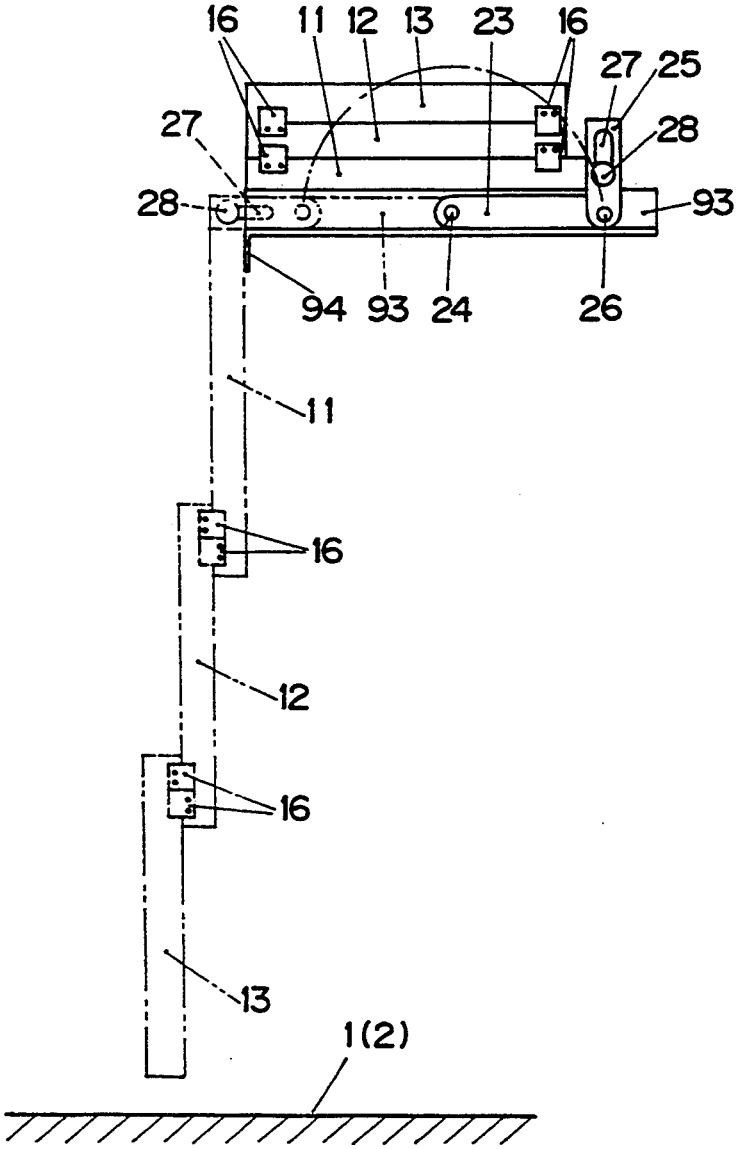
FIG. 5 is a diagram illustrating a modified constitution for mounting the ladder for climbing up to and down from the working floor of the embodiment of the present invention.

The structure for mounting the ladder 10 can be modified as shown in FIG. 5.

One side of an angle steel 93 is fastened to both sides of the tread 9, and the tip of the other side is downwardly bent to form a stopper portion 94. The base end of a rotary arm 23 is pivotally secured by a rotary shaft 24 to the side surface at an intermediate portion on one side of the angle steel 93 that is fixed. An end of a link 25 is pivotally secured by a pin 26 to the tip of the rotary arm 23, and a rotary shaft 28 at the other end (end without coupling member 16) of both side frames of the divided unit 11 is brought into engagement with a groove 27 formed in the other end of the line 25.

In a state in which the ladder 10 is folded and placed on the tread 9, the rotary arm 23 is horizontal on the rear end of one side of the angle steel 93 and the link 25 is standing vertically. It is preferable that the link 25 is pivotal in a direction to an angle larger than a right angle but not allowed to pivot in the direction where the ladder 10 is folded.

To use the ladder 10, the rotary arm 23 is turned about the rotary shaft 24 counterclockwise (FIG. 5) by 180 degrees together with contracted ladder 10. The rotary arm 23 is then on the tip end of the angle steel 93, and the link 25 is pivoted so as to be in line with the rotary arm 23. Then, the rotary shaft 28 of the divided unit 11 moves along the groove 27, and contracted ladder 10 hangs from the tip of the tread 9. In this case, the side frames 14, 14 of the divided unit 11 come into contact with the stopper portions 94, 94, and the ladder 10, that is hanging, is stabilized to prevent at least the hanging tread 9 from swinging counterclockwise (FIG. 5).

By removing the stop pin 22 in the same manner as described in the embodiment of FIG. 1, the divided units 11, 12 and 13 of the ladder 10 are allowed to slide relative to each other, and the divided unit 13 is pulled down until the ladder 10 is extended to a predetermined length determined by the coupling members 16 that come into contact with each other thereby so establish a state shown by dash-and-dot lines in FIG. 5.

Under this condition, the worker climbs up the ladder 10 to the tread 9 from the working floor 1 (or 2), goes into the intra-arch working floor 8, passing through the frame F, and carries out the work in the arch. After the work, the operator returns to the working floor 1 (or 2) from the intra-arch working floor 8.

To accommodate the ladder 10 after it has been used, the ladder 10 is contracted in the same manner as described above, the divided units 11, 12 and 13 are locked together as a unitary structure by using the stop pin 22 and the perforated hook-like brackets 20, and the rotary arm 23 is turned about the rotary shaft 24 clockwise (FIG. 5) by 180 degrees together with the contracted ladder 10 and is placed at the outer end of the angle steel 93. Then, the link is turned to an upright position which is perpendicular to the rotary arm 23, whereby the rotary shaft 28 of the divided unit 11 moves along the groove 27, and the contracted ladder 10 is accommodated and is placed on the tread 9.

In the foregoing was described the ladder 10 for climbing up to and down from the intra-arch working floor 8. The ladder 10 for climbing up to and down from the working floors 5 and 6 need to be constituted in the same manner as above. In this case, however, the tread 9 is omitted, and the guide member 91 and the angle steel 93 may be directly provided on the working floors 5 and 6, and the ladder 10 may be directly coupled to the working floors 5 and 6.

The ladder for climbing up to and down from the working floors of the printing press of the present invention can be provided close to the working places on the upper working floors for the press units of the printing press in which a plurality of press units are arranged in tiers in the direction of height. When not in use, the ladder is folded and placed on the upper working floor without hindering the working or walking of the workers on the lower working floor where the worker usually carry out the work.

To use the ladder, it can be easily extended by hand enabling the worker to quickly arrive at a desired working floor from a working place near the desired working floor and, thus, making it possible to quickly take an emergency measure on the upper floors.

Furthermore, the ladder is simply constituted so that it can be manually extended or contracted by a worker when he (she) uses or folds it. Therefore, the ladder is produced at a cost lower than that of the conventional working floors of the type driven to elevate or lower, and does not require any particular checking or maintenance, offering a great advantage in reducing cost.

While the present invention has been described above with respect to typical preferred embodiments thereof, it should of course be understood that it should not be limited only to such embodiments but various changes or modifications may be made without departure from the scope of the invention as defined by the appended claims.

What is claimed is:

1. A printing press assembly, comprising:

(a) a plurality of press units vertically arranged in a plurality of tiers, said plurality of tiers at least including a lower tier and an upper tier above said lower tier;

(b) an upper working floor upon which an individual can stand to obtain access to said upper tier;

(c) a ladder for climbing up to and down from said upper working floor, said ladder including:

(i) a first divided unit having generally parallel side frames and steps between said side frames, and at least one movable member having a mounting portion;

(ii) said first divided unit being connected at one end thereof to said at least one movable member which is movably connected to said upper working floor via said mounting portion, (iii) said first divided unit being movable between a first state wherein said first divided unit is stored generally parallel to and proximate said upper working floor and a second state wherein said first divided unit extends downwardly from said upper working floor, wherein when said first divided unit is moved from said first state to said second state said one end of said first dividing unit is moved in the direction of an opposite end of said first divided unit at an opposite end of said side frames from said one end, (iv) said first divided unit having at least one coupling member proximate said opposite end, (v) a second divided unit having generally parallel side frames and steps between said side frames, (vi) said second divided unit having at least one coupling member located proximate one end thereof and engagable with said at least one coupling member of said first divided unit, (vii) said second divided unit being movably connected to said first divided unit such that said second divided unit is movable between a first state wherein said second divided unit is stored generally parallel to and proximate said upper working floor and upon said first divided unit, in said first state of said first divided unit, and a second state wherein said second divided unit extends downwardly from said upper working floor and below said first divided unit with said at least one coupling member of said first divided unit and said at least one coupling member of said second divided unit being engaged together, in said second state of said first divided unit.

2. A printing press assembly as claimed in claim 1, wherein said upper working floor includes a tread coupled to said upper working floor and said mounting portion is provided on said tread, said ladder, when stored, being accommodated on said tread.

3. A printing press assembly as claimed in claim 1, wherein said mounting portion includes at least one guide member and said movable member includes at least one roller which is slidable along said at least one guide member.

4. A printing press assembly as claimed in claim 1, wherein said movable member includes at least one rotating shaft which is rotatably attached to said mounting portion.

* * * * *